US006232028B1

(12) United States Patent
Landa et al.

(10) Patent No.: US 6,232,028 B1
(45) Date of Patent: May 15, 2001

(54) ORGANIC PHOTOCONDUCTOR AND TREATMENT THEREFOR

(75) Inventors: Benzion Landa, Nes-Ziona; Yosef Yossi Rosen; Gilad Tzori, both of Moshav-Sitria, all of (IL)

(73) Assignee: Indigo N.V., Maastricht (NL)

( * ) Notice: Subject to any disclaimer, the term of this patent is extended or adjusted under 35 U.S.C. 154(b) by 0 days.

(21) Appl. No.: 09/380,869

(22) PCT Filed: Mar. 13, 1997

(86) PCT No.: PCT/IL97/00095

§ 371 Date: Sep. 10, 1999

§ 102(e) Date: Sep. 10, 1999

(87) PCT Pub. No.: WO98/40793

PCT Pub. Date: Sep. 17, 1998

(51) Int. Cl.[7] ..... G03G 5/00

(52) U.S. Cl. ..... 430/130; 427/374.1; 264/171.25; 264/237

(58) Field of Search ..... 430/130; 427/374.1; 264/171.25, 237

(56) References Cited

U.S. PATENT DOCUMENTS 5,240,532 * 8/1993 Yu ..... 430/127
5,376,491 12/1994 Krumberg et al. ..... 399/161
5,508,790 4/1996 Belinkov et al. ..... 430/136

FOREIGN PATENT DOCUMENTS

WO 91 17485 11/1991 (WO) .

OTHER PUBLICATIONS

R.C.U.YU.: "IIeat Shrinkage of photoreceptor belt ont o a drum" Xerox Disclosure Journal, vol. 20, No. 2, Mar. 1, 1995–Apr. 30, 1995, Stamford Connecticut USA, pp. 141–141, XP000512582.

* cited by examiner

*Primary Examiner*—Mark Chapman
(74) *Attorney, Agent, or Firm*—Fenster & Company Patent Attorneys, Ltd.

(57) ABSTRACT

A method of processing a photoconductor comprising: providing a photoconductor having a base layer and a photoconductive layer; bending the photoconductor with the photoconductive layer facing outward without subjecting the photoconductor to substantial external stress other than by virtue of said bending; heat treating the bent; and allowing the bent photoconductor to cool.

31 Claims, 1 Drawing Sheet

ORGANIC PHOTOCONDUCTOR AND TREATMENT THEREFOR

RELATED APPLICATION

This application is a US National filing of PCT Application PCT/IL97/00095, filed Mar. 13, 1997.

FIELD OF THE INVENTION

The present invention relates to photoconductors generally and more particularly to organic photoconductors and a treatment therefor.

BACKGROUND OF THE INVENTION

Various types of organic photoconductors are known. Most organic photoconductors are susceptible to attack by organic solvents of the type used in liquid toner electrophotography and are therefore unsuitable for such applications. These photoconductors include those which dissolve in the solvents and others which are caused to crack as the result of exposure thereto when they are under stress, especially when under tension.

It is known in the art to provide protective coatings for organic photoconductors. Examples of these coatings are given in U.S. Pat. Nos. 4,891,290 and 4,894,304.

U.S. Pat. No. 4,497,566 describes a system in which an organic photoconductor is heated to relieve tension in the photoconductor and then cooled immediately prior to its use in an imaging system. In the method described in this patent the photoconductor as a whole is in tension during the entire process with the tension being taken up by the backing layer after the heat treatment. This solution is impractical since it requires that the heat treatment be performed in situ as part of the imaging process itself.

U.S. Pat. No. 5,376,491, the disclosure of which is incorporated herein by reference, describes two methods of treatment for organic photoconductors which are susceptible to cracking used with liquid toner under mechanical stress. One of these methods involves the chemical treatment of the photoconductor to soften the photoconductive layer thereof and a second method which induces a compressive stress in the photoconductive layer. In use, the photoconductive layer, when the photoconductor is wrapped about a drum, remains in compressing and does not crack.

The other methodology for heat treatment of the photoconductor is to subject the photoconductor to tension, heat treat the photoconductor such that stress is relieved in the photoconductive layer, allowing the photoconductor to cool and then removing the stress, prior to utilizing the photoconductor in an imaging process.

R. C. U. YU, "Heat Shrinkage of Photoreceptor Belt onto a Drum" Xerox Disclosure Journal, Vol. 20, No. 2, Mar. 1, 1995–Apr. 30, 1995, describes a system whereby a photoreceptor is heat shrunk onto a drum, for later use.

SUMMARY OF THE INVENTION

The present invention provides an improved photoconductor which is resistant to cracking in a stressed environment wherein organic solvents of the type used in liquid toner electrophotography are present.

In the present invention a photoconductor comprising a base layer and a photoconductive layer is formed into a curved configuration with the photoconductive layer facing outward. In this position, without applying any stress on the photoconductor, the photoconductive layer is subjected to a heat treatment which relives the stress in the photoconductor. After relieving the stress, the photoconductor is either cooled or allowed to cool while it is still in the curved position to a temperature below a stress relief temperature thereof.

As a result of this treatment, when the photoconductor is flattened, or when it is bent with a radius of curvature larger than that at which the photoconductive layer was stress relieved and cooled, there will be a built-in compression in the layer which will enable it to better resist cracking.

In a preferred embodiment of the invention, the base layer is not stress relieved, i.e., the temperature to which it is heated in heat treatment is below its stress relief temperature. Preferably, the radius of the bend in the photoconductor at which the stress relief and, more importantly, the cooling takes place is smaller than the radius of a drum on which it is mounted.

There is thus provided, in accordance with a preferred embodiment of the invention a method of processing a photoconductor comprising:

- providing a photoconductor, preferably an organic photoconductor, having a base layer and a photoconductive layer;
- bending the photoconductor with the photoconductive layer facing outward without subjecting the photoconductor to substantial external stress other than by virtue of said bending;
- heat treating the bent photoconductor, preferably to a temperature above a stress relief temperature of the photoconductive layer such that stress in the photoconductive layer is relieved; and
- cooling the bent photoconductor.

There is further provided, in accordance with a preferred embodiment of the invention, a method of processing a photoconductor comprising:

- providing a long photoconductor sheet having a base layer and a photoconductive layer;
- serially supplying contiguous portions of the photoconductor sheet in a bent configuration with the photoconductive layer facing outward at a heating station at which the bent photoconductor is heat treated; and
- cooling the bent photoconductor.

In one preferred embodiment of the invention the photoconductor is heated to a temperature at which stress in the base layer is not relieved. Alternatively the photoconductor is heated to a temperature at which stress in the base layer is relieved.

In a preferred embodiment of the invention cooling the bent photoconductor comprises allowing the bent photoconductive layer to cool by convection. In one preferred embodiment of the invention, cooling the photoconductive layer comprises contacting the photoconductive layer with a cooling fluid which may comprise a gas.

In a preferred embodiment of the invention, the photoconductive layer is allowed to cool to a temperature below a stress relief temperature of the photoconductive layer in the bent condition. Preferably, the stress relief temperature of the photoconductive layer is the glass transition temperature of a charge transport layer comprised therein and wherein the photoconductive layer is heated above the glass transition temperature in the bent condition and then allowed to cool to below that temperature while it is still bent.

Preferably, the photoconductive layer comprises a charge transport layer having a glass transition temperature.

In a preferred embodiment of the invention, the photoconductor is heated by contacting it with hot water. In an alternative preferred embodiment of the invention the photoconductor is heated by contacting it with steam. Preferably, the photoconductive layer is heated to a temperature of over 80° C., more preferably above 90° C. and below 95° C. most preferably about 92° C. Alternatively it can be heated to a temperature below 80° C. or above 95° C. It should be understood that for higher temperatures, the amount of time during which the photoconductor must be treated for crack avoidance is reduced. In a particular example, eight minutes of treatment are required at 80° C. and only one minute is required at 90° C.

Preferably, the photoconductive layer is allowed to cool to a temperature of 40° C. prior to removing the bend therefrom.

Preferably the bend has a radius substantially smaller than that of the drum on which the photoconductor is to be mounted. Preferably the radius is above about 5 mm, more preferably between about 7–30 mm and most preferably about 7 or 8 mm to 11 or 12 mm.

In a preferred embodiment of the invention the photoconductor is in the form of a continuous sheet which is first fed to a heating station, in a curved configuration, at which station it is heated and then fed to a cooling station, at which cooling station it is cooled, still in a curved configuration. In a preferred embodiment of the invention the photoconductor is unbacked by any support at the heating and cooling stations.

There is further provided, in accordance with a preferred embodiment of the invention, an organic photoconductor treated in accordance with the above treatment method.

There is further provided, in accordance with a preferred embodiment of the invention, a method of imaging comprising: placing an organic photoconductor, treated in accordance with the above treatment method, on a drum; forming an electrostatic image on the organic photoconductor, developing the electrostatic image by developing it with a liquid toner to form a developed image; and transferring the image to a final substrate.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENT

Figure 1:
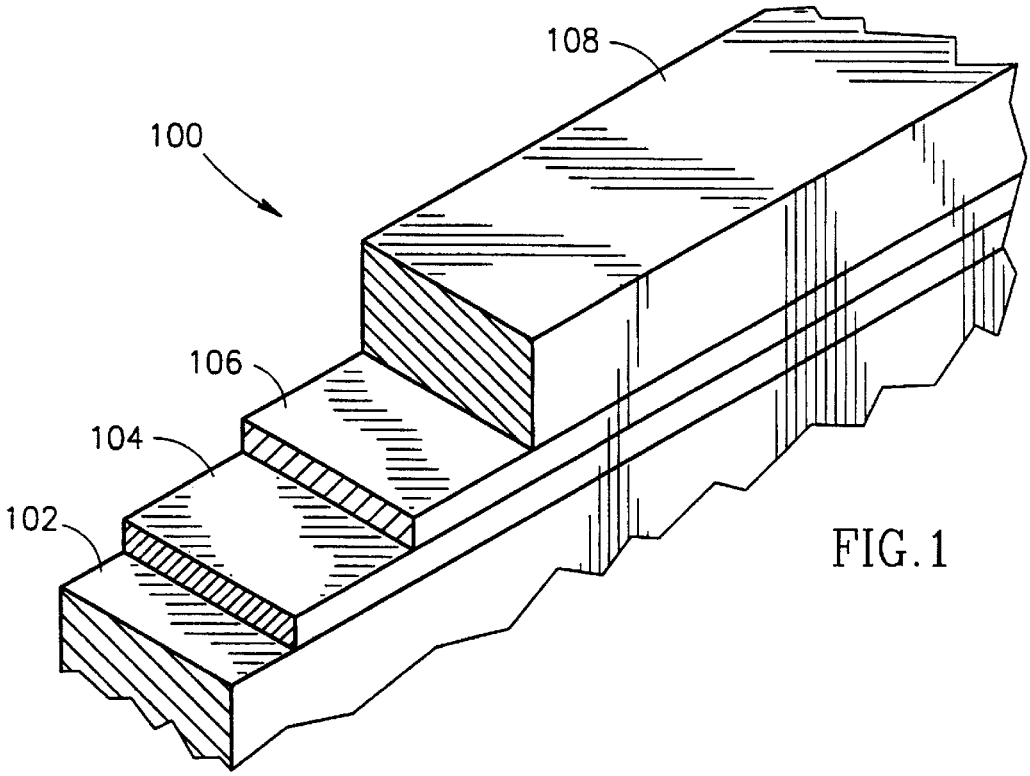
FIG. 1 is a simplified illustration of an organic photoconductor sheet in accordance with a preferred embodiment of the invention.

FIG. 1 illustrates a preferred organic photoconductor sheet, useful in liquid toner imaging. This sheet photoconductor is useful in the liquid toner art, for systems in which the sheet is mounted on a drum. In such systems, untreated photoconductors generally are subject to cracking when they are used with liquid toner, especially those utilizing a hydrocarbon carrier liquid such as Isopar (EXXON). An example of such a system is given in the aforementioned U.S. Pat. No. 5,376,491 and also in U.S. Pat. No. 5,508,790 and Israel Patent Application 117950, the disclosures of which are incorporated herein by reference. However, such systems are only illustrative of the systems with which photoconductors of the present invention can be used.

As shown in FIG. 1, an organic photoconductor sheet 100, according to a preferred embodiment of the invention comprises a base layer 102, typically formed of Aluminized Polyethylene Telephthalate, which is commercially available under the trademark Mylar. The base layer is preferably about 80 microns in thickness and has a melting point of 250° C.

Disposed above the base layer 102 is a sublayer 104, typically formed of Polyester, Toluenesulfonamide-formaldehyde resin and Polyamide and having a thickness of about 0.2 microns. Disposed above the sublayer 104 is a charge generation layer 106, typically formed of Hydroxysquarylium Dye and Toluenesulfonamide-resin and having a thickness of about 0.3 microns.

Disposed above layer 106 is a charge transport layer 108, typically formed of Polyester, Polycarbonate, Yellow Dye, 4-[N,N-diethylamino] benzaldehydedipenylhydrazone and Polysiloxane in a minor proportion, having a thickness of about 18 microns. Charge transport layer 108 and charge generation layer 106 together define the photoconductive layer referred to above.

Figure 2:
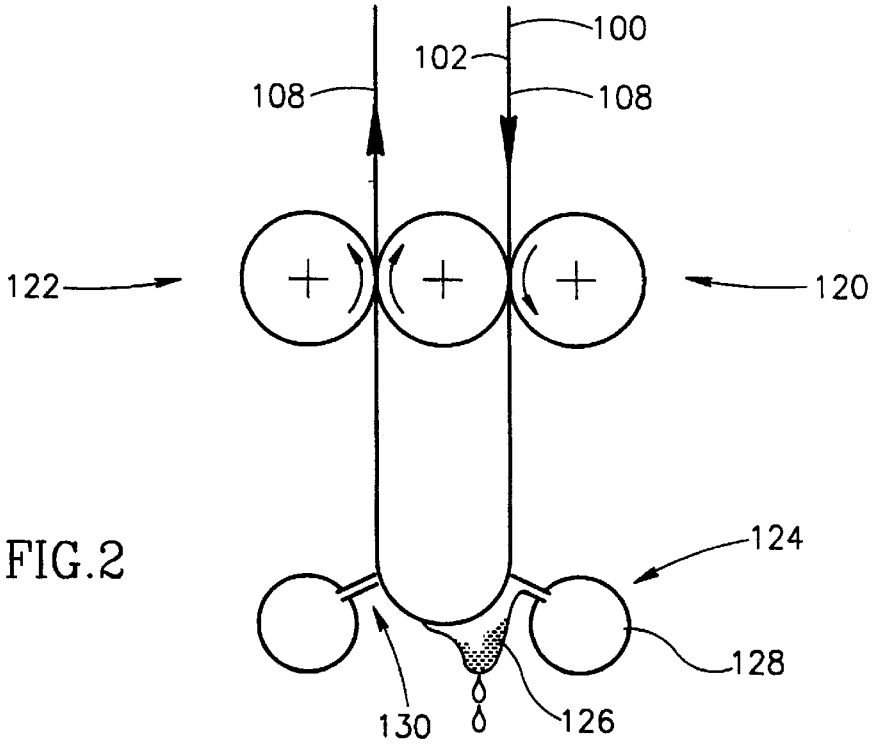
FIG. 2 is a detailed illustration of a method of treating the photoconductor of FIG. 1 in accordance with a preferred embodiment of the present invention.

The organic photoconductor described so far is commercially available from IBM Corporation under the trade name Emerald. In accordance with an embodiment of the present invention, and as illustrated in FIG. 2, the organic photoconductor, as received from IBM Corporation, is subjected to an annealing procedure which will now be described in detail.

Photoconductor sheet 100 is fed through a pair of fed-in guide rollers 120 and is bent, with the photoconductive layer outward, such that it returns through a pair of feed-out guide rollers 122. As shown in FIG. 2, the feed in and feed out function is preferably performed by three rollers with the middle roller related to both a feed in and feed out function. These rollers provide the dual function of feeding the photoconductor in a continuous manner and in forming a bend in the photoconductor in a treatment region between the rollers.

After photoconductor 100 passes rollers 120 it is heated at a heating station 124. In a preferred embodiment of the invention, hot water (or alternatively steam) is sprayed onto the photoconductive layer from holes or slots 126 in a pipe 128. The photoconductive layer is cooled, preferably by forced cooling at a cooling station 130 at which cooling air or other fluid is made to impinge on the hot photoconductive layer, while it is still bent.

It is noted that the photoconductor is preferably heated to a temperature intermediate the stress relief temperature of base layer 102, which is approximately 250° C. and the glass transition temperature of charge transport layer 108, which is approximately 45° C.

Thus, in accordance with a preferred embodiment of the invention, the photoconductive layer is heated to a temperature of at least 45° C. at the heating station and cooled below that temperature at the cooling station. In order to assure stress relief of the photoconductive layer it is preferably heated to about 90°–100° C. at the heating station, although lower or higher temperatures can be utilized. The photoconductive layer is cooled to a temperature of preferably 40° or below prior to removal of the bend.

Although such temperatures do not cause the stress relief of the base layer, such relief is not required for the invention, although heating the photoconductor to temperatures at which the base layer is also stress relieved is possible and within the scope of the invention, if generally inconvenient.

It is noted that in the present invention there is no significant overall stress on the photoconductor during its travel between the two sets of rollers 120 and 122. However, since the heating and cooling occur while the photoconductor is in the bent condition, a built in compression of the photoconductive layer is provided when the sheet is flat or when it is used on a drum having a substantially larger diameter than the radius of bending in the apparatus of FIG. 2. In particular, a bending radius of 10 mm at the heating and cooling stations appears to provide sufficient compression of the photoconductive layer to effectively avoid cracking of the layer, when the photoconductor is used in a liquid toner system mounted used on a drum having a diameter which is greater than that at which the cooling took place.

It should be noted that while the preferred embodiment of the invention provides for an unbacked photoreceptor to be heated and cooled, use of a backing roller is also within the scope of the present invention, so long as no substantial overall tension is applied to the photoreceptor.

In an exemplary embodiment steam or water is used to heat the photoreceptive layer to a temperature of about 95° C. during passage of an Emerald 2 photoreceptor traveling at a rate of 1.2±0.4 cm/sec past heating station 124. During this travel the backing layer is not heated significantly such that cool air at station 130 is sufficient to cool the photoconductive layer below the glass transition temperature. If however, a higher temperature or a faster speed is used, it may be necessary to use a more aggressive cooling method such as using a cool liquid for cooling the photoconductive layer. If a lower temperature and/or a slower speed is used, then convective cooling may be sufficient. It should be understood that for higher temperatures, the amount of time during which the photoconductor must be treated for crack avoidance is reduced. In a particular example, eight minutes of treatment are required at 80° C. and only one minute is required at 90° C.

After treatment in the manner described above, charge transport layer 108 of photoconductor 100 remains stressed under compression, while base layer 102 remains stressed under tension. When photoconductor 100 is mounted on a drum, and subject to external tension, charge transport layer 108 is either in compression or becomes relatively free of stress, and therefore is less susceptible to cracking or other defect generation as the result of exposure to organic solvents, such as Isopar, which are common in a liquid toner electrophotographic environment.

For example, an organic photoconductor 100 which was not annealed as described above, developed cracks after about 500 copy cycles in a liquid toner copier. In contrast, an organic photoconductor which was treated as described above developed no cracks, even after many copy cycles.

It will be appreciated by persons skilled in the art that the present invention is not limited by what has been particularly shown and described hereinabove. Rather the scope of the present invention is defined only by the claims which follow:

What is claimed is:

1. A method of processing and mounting a photoconductor comprising:

providing a photoconductor having a base layer and a photoconductive layer;

bending the photoconductor with the photoconductive layer facing outward without subjecting the photoconductor to substantial external stress other than by virtue of said bending;

heat treating the bent photoconductor;

allowing the bent photoconductor to cool while it is bent with given radius; and mounting the photoconductor on a drum having a radius greater than the given radius after it has cooled.

2. The method of claim 1 wherein the photoconductor is heated to a temperature at which stress in the base layer is not relieved.

3. The method of claim 1 wherein the photoconductor is heated to a temperature at which stress in the base layer is relieved.

4. The method of claim 1 wherein the photoconductive layer is heated to a temperature of over 80° C.

5. The method of claim 4 wherein the photoconductive layer is heated to a temperature of over 90° C.

6. The method of claim 5 wherein the photoconductive layer is heated to a temperature of about 92° C.

7. The method of claim 5 wherein the photoconductive layer is heated to a temperature of over 95° C.

8. The method of claim 1 wherein the bend has a radius of between about 7–30 mm.

9. The method of claim 1 wherein the bend has a radius of between about 8–11 mm.

10. A method according to claim 1 wherein the photoconductor is an organic photoconductor.

11. A method according to claim 1 wherein the photoconductor is heated to a temperature above a stress relief temperature of the photoconductive layer such that stress in the photoconductive layer is relieved.

12. A method of processing a photoconductor comprising:

providing a long photoconductor sheet having a base layer and a photoconductive layer;

serially supplying contiguous portions of the photoconductor sheet in a bent configuration with the photoconductive layer facing outward at a heating station at which the bent photoconductor is heat treated; and cooling the bent photoconductor.

13. A method of processing and mounting a photoconductor, comprising:

providing a photoconductor according to claim 12; and mounting the photoconductor on a support after it has cooled.

14. A method according to claim 13 and including cutting the long photoconductor into pieces and wherein mounting the photoconductor comprises the cut photoconductor on a drum.

15. A method according to claim 14 wherein the bent photoconductor is cooled while bent at a given bending radius and wherein the drum has a radius larger than the given radius.

16. A method according to claim 12 wherein the photoconductor is supplied to the heating station while it is not subject to substantial external stress other than by virtue of said bending.

17. A method according to claim 12 wherein the photoconductor is an organic photoconductor.

18. A method according to claim 17 wherein the photoconductor is heated to a temperature above a stress relief temperature of the photoconductive layer such that stress in the photoconductive layer is relieved.

19. The method of claim 12 wherein the photoconductive layer is allowed to cool to a temperature of 40° C. prior to removing the bend therefrom.

20. The method of claim 12 wherein the photoconductor is in the form of a continuous sheet which is first fed to a heating station, in a curved configuration, at which station it is heated and then fed to a cooling station, still in the curved configuration, at which cooling station it is cooled.

21. The method of any of claims 1–18 wherein cooling the bent photoconductor cool comprises allowing the photoconductive layer to cool by convection.

22. The method of any of claims 1–18 wherein cooling the photoconductive layer comprises contacting the photoconductive layer with a cooling fluid.

23. The method of claim 22 wherein the cooling fluid comprises a gas.

24. The method of any of claims 1–18 wherein the photoconductive layer is allowed to cool in the bent condition to a temperature below a stress relief temperature of the photoconductive layer.

25. The method of any of claims 1–18 wherein the photoconductive layer comprises a charge transport layer having a glass transition temperature and wherein the stress relief temperature of the photoconductive layer is the glass transition temperature of the charge transport layer and wherein the photoconductive layer is heated above the glass transition temperature in the bent condition and then allowed to cool to below that temperature while it is still bent.

26. The method of any of claims 1–18 wherein the photoconductor is heated by contacting it with hot water.

27. The method of any of claim 18 wherein the photoconductor is heated by contacting it with steam.

28. The method of claim 18 wherein the bend has a radius of greater than 5 mm.

29. The method of any of claims 1–18 in which the photoconductor is unbacked by any support during said heating and cooling.

30. An organic photoconductor treated in accordance with any of claims 1–18.

31. A method of imaging comprising:

forming an electrostatic image utilizing an organic photoconductor treated and mounted in accordance with any of claim 13, 14, 15, 17, or 18;

developing the electrostatic image by developing it with a liquid toner to form a eloped image; and transferring the image to a final substrate.

* * * * *